US005669540A

United States Patent [19]

Iijima et al.

[11] Patent Number: 5,669,540

[45] Date of Patent: Sep. 23, 1997

[54] MECHANISM FOR DRAWING SUPERIMPOSED WEBS FOR ROTARY PRESS

[75] Inventors: Tkashi Iijima, Yokosuka; Yuhji Iizumi, Kawasaki; Toshio Kobayashi, Yokosuka, all of Japan

[73] Assignee: Tokyo Kikai Seisakusho, Ltd., Tokyo, Japan

[21] Appl. No.: 754,202

[22] Filed: Nov. 20, 1996

Related U.S. Application Data

[63] Continuation of Ser. No. 493,289, Jun. 21, 1995, abandoned.

[30] Foreign Application Priority Data

Jan. 9, 1995 [JP] Japan ..... 7-016377

[51] Int. Cl.[6] ..... B65H 20/02; B65H 20/28

[52] U.S. Cl. ..... 226/177; 226/183

[58] Field of Search ..... 226/176, 177, 226/181, 183, 186, 187; 270/41, 52.07

[56] References Cited

U.S. PATENT DOCUMENTS

| | | | |
|---|---|---|---|
| 2,153,214 | 4/1939 | Tondreau | 226/183 |
| 3,279,668 | 10/1966 | Fleischer | 226/176 |
| 3,777,964 | 12/1973 | Kruner et al. | 226/183 |

FOREIGN PATENT DOCUMENTS

| | | |
|---|---|---|
| 61-72550 | 5/1986 | Japan . |
| 2-43159 | 2/1990 | Japan . |
| 4-19012 | 4/1992 | Japan . |

OTHER PUBLICATIONS

"Newspaper Print, Printing Section, Revised Edition", Japanese Newspaper Association, Oct. 31, 1980, p. 49.

*Primary Examiner*—Daniel P. Stodola
*Assistant Examiner*—Matthew A. Kaness
*Attorney, Agent, or Firm*—Armstrong, Westerman, Hattori, McLeland & Naughton

[57] ABSTRACT

A mechanism for drawing superimposed webs in a rotary press comprises: a drag roller provided between a printing press and a folding machine so as to be rotated and driven at a peripheral velocity suitably higher than that of a plate cylinder; a plurality of propeller rollers operative for selective engagement with or disengagement from the edge portions at the respective sides of a plurality of printing webs which are superimposed upon each another and wound around the outer peripheral surface of the drag roller, the propeller rollers being rotatable and provided along the outer peripheral surface of the drag roller at both ends thereof; and pressing apparatus for pressing the propeller rollers onto the edge portions of the printing webs. The plurality of printing webs fed from the printing press, superimposed upon each another and wound around the outer peripheral surface of the drag roller, are respectively pressed along their edge portions at opposite sides thereof onto the outer peripheral surface of the drag roller by the plurality of propeller rollers and are simultaneously drawn by rotating and driving the drag roller, to be supplied to the folding machine.

2 Claims, 2 Drawing Sheets

MECHANISM FOR DRAWING SUPERIMPOSED WEBS FOR ROTARY PRESS

This application is a continuation of application Ser. No. 08/493,289 filed Jun. 21, 1995, now abandoned.

BACKGROUND OF THE INVENTION

1. Field of the Invention

The present invention relates to a mechanism for drawing superimposed paper webs in a rotary press which is adapted to draw and advance a plurality of superimposed printing paper webs fed from a printing press.

2. Description of the Prior Art

As prior art mechanisms for drawing and advancing a plurality of superimposed printing webs comprising a drag roller and propeller rollers to compress the printing webs onto the outer peripheral surface of the drag roller, various kinds of apparatuses, mentioned below, have been widely known. For example, one of these apparatuses is disclosed in the description on line 2 of the left column to line 23 of the right column of page 49 and illustrated by Photograph 21 in FIGS. 59 and 60, etc. on the same page of "Newspaper Printing, Printing Section, Revised Edition" (published by Japanese Newspaper Association, Oct. 31, 1980). Further, other types of mechanisms, including the mechanism disclosed in the specification of Japanese Unexamined Utility Model Publication No. S-61-72550, the mechanism disclosed in Japanese Unexamined Patent Publication No. H-2-43159 and the mechanism disclosed in Japanese Examined Utility Model Publication No. H-4-19012, have been known.

In these prior art mechanisms for drawing superimposed printing webs, the peripheral velocity of a drag roller is set so as to be slightly higher than that of the printing webs fed from a mechanism located upstream thereof in order to achieve stable travel of the printing webs. Additionally, the drag roller is designed to rotate while the outer surface of the drag roller slides slightly on the surfaces of the printing webs. Further, in the prior art, the pressure of the outer surfaces of the propeller rollers exerted on the outer surface of the drag roller can be changed to modify the frictional force between the outer peripheral surface of the drag roller and the surfaces of the printing webs. Thus, the drawing force of the drag roller for pulling the printing webs, i.e. the tension imposed upon the printing webs, can be adjusted.

In addition, in the above-stated prior art, since compression against the drag roller through the propeller rollers of areas where scanning lines exist on either the front and/or rear surfaces of the printing webs stains the outer peripheral surfaces of the propeller rollers and/or the drag roller due to these scanning lines and, further, these stains stain the printing webs, this process is not performed.

In the above mentioned prior art mechanisms for drawing printing webs, the pressing force of the outer peripheral surfaces of the propeller rollers exerted on the outer peripheral surface of the drag roller is adjusted so that the frictional force between the outer surface of the drag roller and the printing webs is controlled in order to apply such a tension as to make each printing web run stably onto all of the other superimposed printing webs.

However, in the case of the above-stated prior art, adjustment of the frictional force between the outer peripheral surface of the drag roller and the printing webs by adjusting the pressure of the outer peripheral surfaces of the propeller rollers against the outer peripheral surface of the drag roller requires an increase in the pressure of the propeller rollers as the number of printing webs increases. The increase in the pressure of the propeller rollers, as described in the specification of the above-stated Japanese Unexamined Utility Model Publication No. S-61-72550, causes the structure of the outer peripheral surface of the drag roller to be imposed on the printing webs, leading to degradation of printed matter. Additionally, the load exerted on the propeller rollers increases, which results in a decrease in the lifetime thereof.

Further, unexpected damage to the propeller rollers due to the wear thereof causes the printing webs to be broken or the drag roller to be damaged, possibly causing serious trouble in the operation of the rotary press.

Therefore, since the pressure of the outer peripheral surfaces of the propeller rollers against the outer peripheral surface of the drag roller cannot be significantly increased, adjustment of the tension of the printing webs is unfavorably restricted to a narrow range. As a result, the desired tension may not be obtainable.

Various measures to solve the above-mentioned problems are discussed in the specifications of Japanese Unexamined Utility Model Publication No. S-61-72550, Japanese Unexamined Patent Publication No. H-2-43159 and Japanese Examined Utility Model Publication No. H-4-19012.

In the mechanism for drawing superimposed printing webs disclosed in the specification of Japanese Unexamined Utility Model Publication No. S-61-72550, portions of the outer surface of the drag roller facing the propeller rollers are formed flat and the printing webs are designed to be compressed against the flat surface portions by the propeller rollers.

Consequently, one of the above-stated problems, i.e. the problem that the structure of the outer peripheral surface of the drag roller is imposed on the printing webs, is solved. However, concerning the other problem, i.e. the problem that the load exerted on the propeller rollers increases, if the pressure imposed onto the flat surface portions does not increase, a tension substantially equal to that obtained before execution of the above-mentioned measure cannot be realized, exacerbating rather than solving the problem.

In the case of the mechanism for drawing superimposed printing webs disclosed in Japanese Unexamined Patent Publication No. H-2-43159, a plurality of printing webs superimposed on the outer peripheral surface of a drag roller are compressed against the outer peripheral surface of the drag roller by propeller rollers. Then, only the lowermost printing web of the plurality of printing webs, which is in direct contact with the drag roller, is guided in such a way that the contact angle of the printing web relative to the outer peripheral surface of the drag roller is increased at the upstream side of the drag roller. Further, other propeller rollers for compressing only the lowermost printing web against the outer surface of the drag roller are added, so that the lowermost printing web is compressed against the outer peripheral surface of the drag roller by these additional propeller rollers. As a result, the frictional force of the printing web relative to the drag roller is increased and the tension of the lowermost printing web is controlled and adjusted. In this way, an assured and stable frictional force can be obtained between the lowermost printing web and the outer peripheral surface of the drag roller.

However, since consideration is not given to frictional forces between other printing webs superimposed upon the lowermost printing web, as the number of printing webs superimposed thereupon increases, the pressure required for pressing the superimposed printing webs against the outer peripheral surface of the drag roller through the propeller rollers ultimately increases. Therefore, the above-described problems cannot be completely overcome.

Further, at the upstream side of the drag roller, guide means are required for guiding the lowermost printing web to increase the contact angle thereof relative to the outer surface of the drag roller. Thus, it is necessary to secure a space for installing the guide means and a space for a web passing for guiding the lowermost printing web to the guide means, so that a relatively large space for installation is required. Accordingly, it becomes difficult to mount additional members onto, or reconstruct, an existing rotary press.

In the case of the mechanism for drawing superimposed printing webs disclosed in Japanese Examined Utility Model Publication No. H-4-19012, a plurality of drag rollers are provided with propeller rollers for each one thereof, and a plurality of printing webs are superimposed one upon another on the outer peripheral surface of the drag roller located at the most upstream side. An uppermost printing web and a lowermost printing web of the plurality of superimposed printing webs are sequentially and alternately pressed to the outer surface of each of the drag rollers through the propeller rollers so that the plurality of the superimposed printing webs are drawn from the uppermost printing web side and the lowermost printing web side. Therefore, even if the number of printing webs to be superimposed one upon another is increased, the difference in tension between the respective printing webs can be eliminated, solving this problem.

However, in this case, a plurality of drag rollers must be provided and further, driving means must be provided and connected to each of the drag rollers, therefore the overall mechanism needs to be enlarged in scale, requiring a large space for installation. Consequently, it becomes difficult to add peripheral members to or reconstruct the existing rotary press.

SUMMARY OF THE INVENTION

An object of the present invention is to simultaneously solve the above-mentioned problems in the prior art and provide a mechanism for drawing together superimposed printing webs in a rotary press in which a frictional force applied to the superimposed printing webs can be increased without increasing the pressure exerted by individual propeller rollers within a single drag roller when the superimposed printing webs are drawn together at the same time by the drag roller, broadening the range of frictional force obtained.

Another object of the present invention is to provide a mechanism for drawing superimposed printing webs in a rotary press in which the disadvantage that the form of the outer peripheral surface of a drag roller is imposed on the printing webs because of excessively strong pressure being used to compress the printing webs against the drag roller and thereby deteriorating the quality of a product can be avoided, a load applied to propeller rollers can be also reduced, and unexpected breakage of the propeller rollers can be avoided.

Still another object of the present invention is to provide a mechanism for drawing superimposed printing webs in a rotary press in which an existing rotary press can be reconstructed and other members added thereto.

These and other objects, such as will be apparent hereinafter, are achieved by a mechanism for drawing superimposed printing webs in a rotary press comprising a drag roller provided between a printing press and a folding machine and rotated and driven at a peripheral velocity properly higher than that of a plate cylinder, a plurality of propeller rollers capable of being engaged with and disengaged from edge parts at both ends of a plurality of printing webs which are superimposed one upon another and wound around the outer peripheral surface of the drag roller, the plurality of propeller rollers being rotatable and provided along the outer peripheral surface and at both ends of the drag roller, and pressing means for pressing the propeller rollers onto the edge parts at both ends of the printing webs wound on the outer peripheral surface of the drag roller.

In the above-described mechanism for drawing the superimposed printing webs, the plurality of printing webs fed from the printing press, superimposed one upon another and wound on the outer peripheral surface of the drag roller, are compressed at their edge portions on both sides against the outer peripheral surface of the drag roller by the plurality of propeller rollers, and are simultaneously drawn by rotating and driving the drag roller, to be supplied to the folding machine.

In the rotary press, a plurality of printing webs guided toward the drag roller through separate printing presses are superimposed one upon another at the drag roller or at a suitable position located upstream of the drag roller, wound around the outer peripheral surface of the drag roller, and then guided therethrough so as to reach the folding machine.

At this time, the propeller rollers are initially separated from the outer surface of the drag roller. Then, the driving means operates to move the propeller rollers toward the outer surface of the drag roller and press the uppermost printing web of the plurality of printing webs, superimposed one upon another and wound around the outer peripheral surface of the drag roller at edge parts thereof, against the outer surface of the drag roller.

In this state, when the rotary press is operated and driven, the drag roller rotates at a peripheral velocity suitably higher than that of the plate cylinder, and the printing webs which are superimposed one upon another are simultaneously drawn or pulled in accordance with the rotation of the drag roller by virtue of the frictional force acting respectively between the outer peripheral surface of the drag roller and the lowermost printing web of the plurality of superimposed printing webs and between the adjacent printing webs of the superimposed printing webs, to be fed to the folding machine.

BRIEF DESCRIPTION OF THE DRAWINGS

Further features and advantages will be more readily apparent from the following detailed description of the mechanism for drawing superimposed printing webs in a rotary press according to the present invention, described in the following embodiments and illustrated in the accompanying drawings, wherein.

DETAILED DESCRIPTION OF THE PREFERRED EMBODIMENTS

Referring to the accompanying drawings, embodiments of the mechanism for drawing superimposed printing webs in a rotary press according to the present invention will be described hereinafter.

Figure 1:
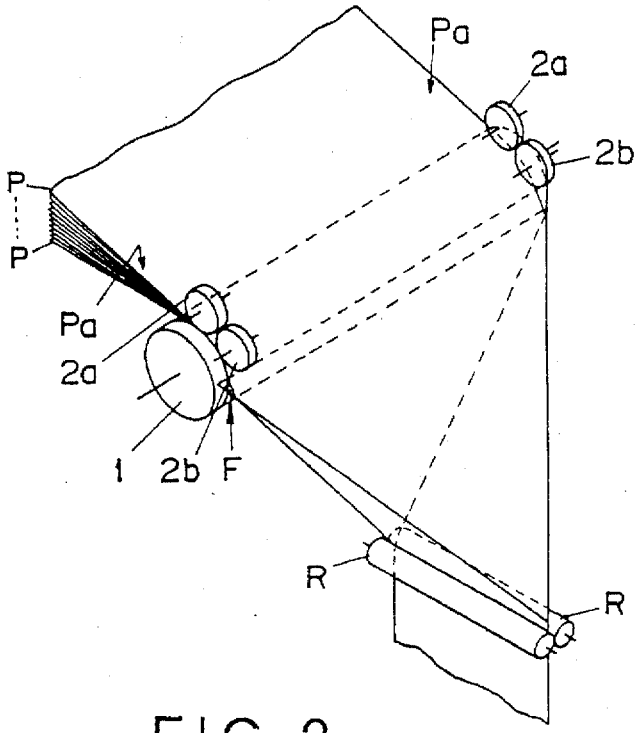
FIG. 1 is an overall schematic representation illustrating the structure and arrangement of a mechanism for drawing superimposed printing webs in a rotary press according to an embodiment of the present invention.

As schematically illustrated in FIG. 1, in the mechanism for drawing superimposed printing webs in a rotary press, a drag roller 1 is provided in an upper part of a folding machine (not shown) adjacent the forming portion thereof, which is generally and schematically represented in the drawings by the designation, "F", so as to be rotated and driven at a peripheral velocity suitably higher than that of a plate cylinder. A plurality of propeller rollers are rotatably provided at positions facing edge parts Pa and Pa at both ends of printing webs P Wound around the outer peripheral surface of the drag roller 1, and along the peripheral surface of the drag roller 1. In the illustrated embodiment, two pairs of propeller rollers 2*a* and 2*b*, respectively, face portions proximate to both ends on the outer peripheral surface of the drag roller 1 and are mounted so as to be capable of engaging therewith and disengaging therefrom.

Then, a plurality of printing webs P fed from a printing press (not illustrated) and superimposed one upon another are wound by a prescribed angle around the outer peripheral surface of the drag roller 1. The edge portions Pa and Pa at both sides of the printing webs are pressed against the outer peripheral surface of the drag roller 1 by the propeller rollers 2*a*, 2*b* and 2*a*, 2*b*. Thus, the plurality of printing webs are simultaneously drawn upon rotation of the drag roller 1 and fed toward the former, or forming portion F of the folding machine (not shown). Thereafter, the printing webs P passing through the former F to be folded in their longitudinal direction are guided to guide rollers R (at the bottom of FIG. 1) provided in the lower part of the forming machine and supplied to other sections.

The propeller rollers will be more specifically described herebelow. In a first embodiment shown in FIG. 2, a base portion of a bracket 3 is attached to a stay S supported between frames at both sides, which are not shown. The bracket 3 is provided with the pairs of propeller rollers 2*a* and 2*b*, respectively, provided at positions facing the edge portions Pa and Pa at either side of the printing webs P wound around the outer peripheral surface of the drag roller 1. The bracket 3 is formed in a suitable shape so that at least one pair of propeller rollers 2*a* and 2*b* can be provided thereon.

The two pairs of propeller rollers 2*a* and 2*b*, one pair at each end of the drag roller, are identical with each other, therefore one of each of the pairs of propeller rollers 2*a* and 2*b* provided at a position facing only one edge portion Pa of the printing webs P will be described.

At an end part of the bracket 3, the intermediate portions of swing arms 4*a* and 4*b* having an appropriate form, such as a straight or bent arm, or the like are respectively rotatably supported by support shafts 5*a* and 5*b*. The propeller rollers 2*a* and 2*b* are respectively rotatably supported at the ends of the swing arms 4*a* and 4*b* which face each other.

Further, the ends of each of cylindrical portions of a pair of hydraulic cylinders 6*a* and 6*b* are rotatably pin-connected to suitable positions of the bracket 3 through connection brackets 7*a* and 7*b*. The ends of piston rods of the hydraulic cylinders 6*a* and 6*b* are rotatably connected through pins 8*a* and 8*b* to other end portions of the swing arms 4*a* and 4*b*.

The respective axes of rotation of the pin connections at both ends of the propeller rollers 2*a* and 2*b*, swing arms 4*a* and 4*b* and fluid pressure cylinders 6*a* and 6*b* are parallel to the axis of rotation of the drag roller 1. Fluid pressure circuits, which are not shown, are connected to the cylinder portions of the fluid pressure cylinders 6*a* and 6*b* so that a pressure fluid whose pressure is properly adjusted is supplied to and discharged from the cylinders.

The piston rods are moved back and forth upon operation of the fluid pressure cylinders 6*a* and 6*b* by the supply and discharge of pressure fluid whose pressure is appropriately adjusted. Thus, the swing arms 4*a* and 4*b* are swung about the respective support shafts 5*a* and 5*b* as supporting points in directions opposing each other. Specifically, with reference to FIG. 2, when the piston rods protrude, or are moved forward, the swing arm 4*a* swings counterclockwise while the swing arm 4*b* swings clockwise, and the propeller rollers 2*a* and 2*b* are disengaged from the outer surface of the drag roller 1. On the other hand, when the piston rods are contracted, or moved backward, the swing arm 4*a* swings clockwise while the swing arm 4*b* swings counterclockwise, then the propeller rollers 2*a* and 2*b* are engaged with and urged against the outer peripheral surface of the drag roller 1.

Now, the operation of the above-described mechanism for drawing superimposed printing webs in a rotary press will be described below.

In a rotary press, a plurality of printing webs P, P, P, etc., guided to the drag roller 1 through separate printing presses, which are not illustrated in the drawings, are superimposed one upon another on the drag roller 1, or at a proper position located upstream of the drag roller 1. Then, the plurality of printing webs P are wound by a prescribed contact angle around the outer peripheral surface of the drag roller 1, further reaching the forming portion F of the folding machine (not shown) to be folded longitudinally and guided to a lower portion in FIG. 1 through the guide rollers R.

At this time, the piston rods of the fluid pressure cylinders 6*a* and 6*b* initially protrude or are moved forward, so that the propeller rollers 2*a*, 2*b* and 2*a*, 2*b* are separated from the outer peripheral surface of the drag roller 1. However, when the paths of the fluid pressure circuits are switched to operate the fluid pressure cylinders 6*a* and 6*b*, the piston rods are retracted. Then, the swing arm 4*a* swings clockwise and the swing arm 4*b* swings counterclockwise, respectively. The propeller rollers 2*a* and 2*b* move forward toward the edge portion Pa of the uppermost printing web P of the printing webs superimposed one upon another and wound around the outer peripheral surface of the drag roller 1 to thereby press that edge portion Pa to the outer peripheral surface of the drag roller 1. More specifically, the edge parts Pa and Pa at both ends of the printing webs are substantially uniformly pressed against the outer peripheral surface of the drag roller 1 by a pressure of a strength determined by the pressure of a pressure fluid adjusted in the fluid pressure circuits.

Figure 2:
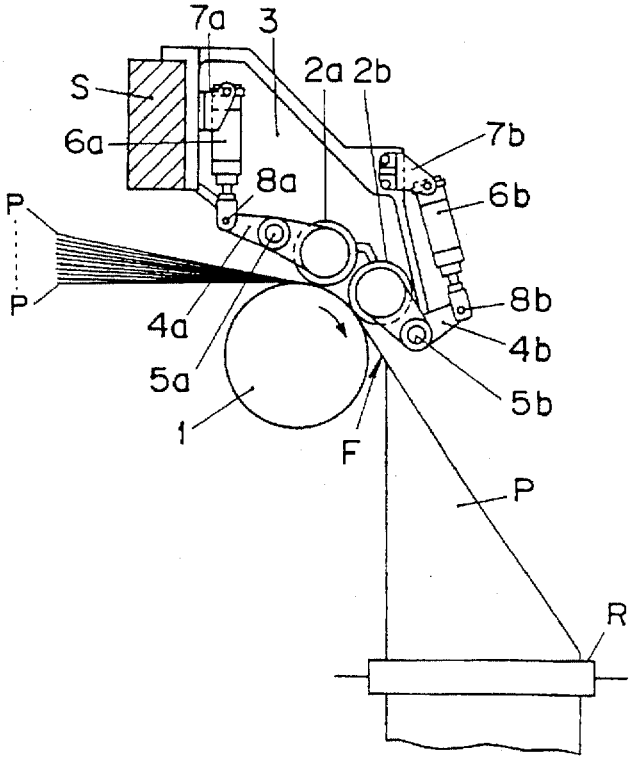
FIG. 2 is a side view of a mechanism for drawing superimposed printing webs according to a first embodiment of the present invention.

In this state, when the rotary press is operated, the drag roller 1 rotates clockwise as viewed in FIG. 2, at a peripheral velocity suitably higher than that of the plate cylinder. The superimposed printing webs P, P, P, etc. are drawn together at the same time in accordance with the rotation of the drag roller 1 by virtue of the frictional force acting between the outer peripheral surface of the lowermost printing web P and the respective superimposed and adjacent printing webs P and P.

The operation for drawing the printing webs P, P, P, etc. by rotating the drag roller 1 depends exclusively on, as described above, the frictional force exerted against the printing webs P, P, P, etc. Additionally, the magnitude of the frictional force imposed upon the printing webs P, P, P, etc. depends on the coefficient of friction between the outer peripheral surface of the drag roller 1 and the lowermost printing web P and between the superimposed adjacent printing webs P, and P, and the strength of the pressure exerted in the radial direction by the propeller rollers 2*a* and 2*b*.

In this manner, the drawing of the superimposed printing webs P, P, P, etc. in accordance with the rotation of the drag roller 1 is adjusted by adjusting the pressure of the propeller rollers by adjustment of the pressure fluid in the fluid pressure circuits connected to the fluid pressure cylinders 6*a* and 6*b*.

It should be understood that the drawing of the printing webs is adjusted by taking into consideration the coefficient of friction between the outer peripheral surface of the drag roller 1 and the lowermost printing web P, and between the superimposed adjacent printing webs P and P, as well as the thickness of the printing web P and the number of superimposed printing webs, since the printing web P is made of a flexible material having high a cushioning property. In addition, the above-mentioned adjustment for drawing the printing webs is performed depending on changes in the running condition of the printing webs P.

Figure 3:
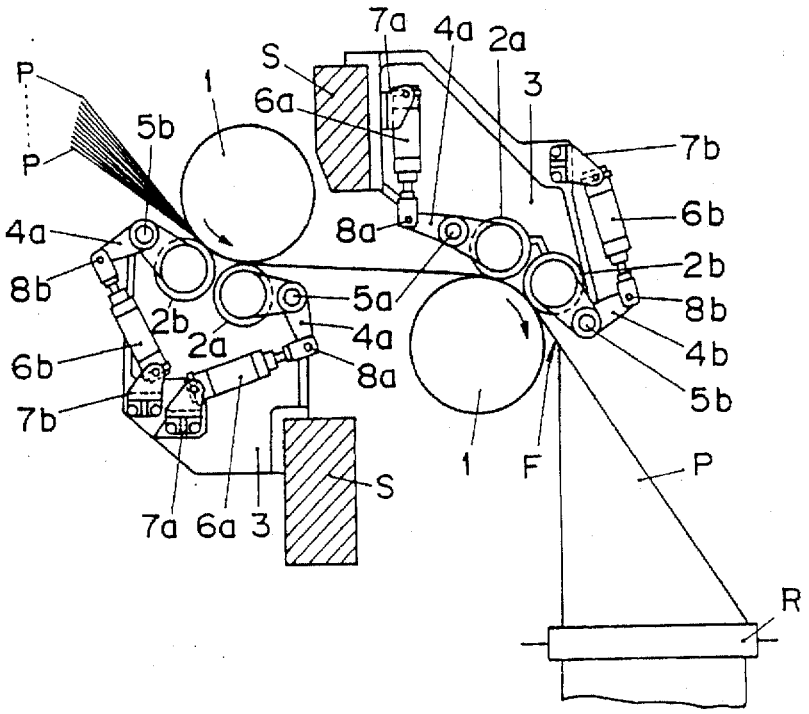
FIG. 3 is a side view of a mechanism for drawing superimposed printing webs according to a second embodiment of the present invention.
Figure 4:
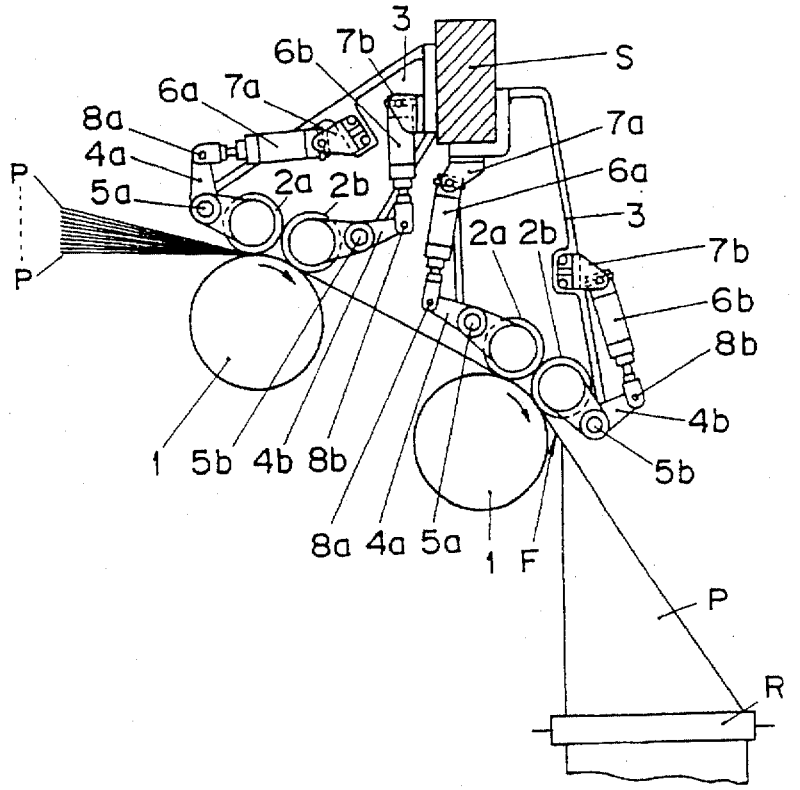
FIG. 4 is a side view of a mechanism for drawing superimposed printing webs according to a third embodiment of the present invention.

As is apparent from the above-mentioned first embodiment of the mechanism for drawing superimposed printing webs in a rotary press, one drag roller 1 and two propeller rollers 2*a* and 2*b* are provided for each of the edge portions at both ends of the printing webs P relative to the drag roller 1. However, in the case of an existing rotary press in which two drag rollers 1 and 1 are already provided at front and rear positions with respect to the direction of travel of the printing webs, or in a case where, since a large frictional force is required, two drag rollers 1 and 1 are provided at front and rear positions in the direction of travel of the printing webs, the propeller rollers 2*a* and 2*b* employed in the first embodiment of the mechanism for drawing superimposed printing webs may be provided at both sides of each drag roller 1. For example, it is understood that the propeller rollers 2*a* and 2*b* employed in the first embodiment may be arranged and constructed as in the second embodiment shown in FIG. 3 or the third embodiment shown in FIG. 4.

According to the second embodiment of the mechanism for drawing superimposed printing webs, the two pairs of propeller rollers 2*a* and 2*b* used in the mechanism for drawing printing webs in the first embodiment are designed to successively press both the upper and lower surfaces at both of the sides of the printing webs P, P, P, etc. In accordance with the third embodiment of the mechanism for drawing superimposed printing webs, the two pairs of propeller rollers 2*a* and 2*b* used in the first embodiment of the mechanism for drawing printing webs are similarly designed to successively press the same surface at both the sides of the printing webs P, P, P, etc.

It should be readily understood that, in the case of the mechanism for drawing printing webs according to the second embodiment, as well as that according to the third embodiment, the respective drag rollers 1 play the same role as that of the drag roller 1 utilized in the mechanism for drawing printing webs according to the first embodiment and a rather larger frictional force can be generated even under the same pressure as that in the first embodiment.

As heretofore mentioned, in accordance with the mechanism for drawing superimposed printing webs in a rotary press of the present invention, when the superimposed printing webs are simultaneously drawn by the drag roller, the frictional force exerted upon the superimposed printing webs can be increased in the single drag roller without increasing the pressure exerted by the individual propeller rollers. Therefore, the range of obtainable frictional force can be widened.

Thus, the inconvenience that the form of the outer peripheral surface of the drag roller is imposed on and marks the printing webs, thereby deteriorating the quality of the end product due to the fact that the force for pressing the printing webs against the drag roller is too strong, can be avoided. Further, the load of the propeller rollers can be reduced and unexpected breakage of the propeller rollers can be avoided.

Additionally, since the mechanism for drawing superimposed printing webs according to the present invention requires a small amount of space for installation, irrespective of the fact that frictional force can be increased using a single drag roller, installation of the mechanism of the invention in a new rotary press can be readily executed and the existing rotary press can be easily reconstructed. Reconstruction of the rotary press can be carried out even when a plurality of the drag rollers are already provided in the existing rotary press.

Furthermore, since the above-stated effects can be readily realized by reconstructing an existing rotary press, it will be appreciated that the reconstruction of the rotary press may be significantly effective in cases where the number of printing presses in a rotary press for a newspaper for example is increased in order to increase the number of pages of the newspaper.

What is claimed is:

1. For use in a rotary press installation including printing press means operative to discharge a plurality of superimposed webs at a selected discharge velocity to a folding machine, a mechanism for disposition between said printing press means and said folding machine, and operative for drawing said superimposed webs from said printing press means for transfer to said folding machine, said mechanism comprising:

a drag roller having an outer peripheral surface operative to receive said superimposed webs discharged from said printing press means and having means for rotating and driving said drag roller at a peripheral velocity suitably higher than the velocity of web discharge;

a plurality of separate, independently operable rotatable propeller rollers disposed adjacent each axial end of said drag roller to cooperate with said drag roller for engaging said superimposed webs at the outer peripheral surface of said superimposed webs along the opposite edges thereof to generate friction forces between said drag and propeller rollers and said superimposed webs to induce movement of said superimposed webs by said drag roller; and independent, selectively actuable means operative to selectively activate each of the propeller rollers to press the edges of the superimposed webs at longitudinally spaced locations against the outer peripheral surface of said drag roller adjacent the respective axial ends thereof, wherein said plurality of superimposed webs are pressed at their edge portions along opposite sides onto the outer peripheral surface of said drag roller independently by each of said propeller rollers for generating sufficient friction forces at the sites of the respective propeller rollers for simultaneously moving said webs through said mechanism through said folding machine by rotation of said drag roller.

2. The mechanism according to claim 1 in which said plurality of propeller rollers comprises a pair of rollers disposed at each axial end of said drag roller.

* * * * *

UNITED STATES PATENT AND TRADEMARK OFFICE

CERTIFICATE OF CORRECTION

PATENT NO.: 5,669,540
DATED : September 23, 1997
INVENTOR(S): Iijima et al.

It is certified that an error appears in the above-identified patent and that said Letters Patent is hereby corrected as shown below:

On the title page;

Item [75], the inventor, "Tkashi Iijima" should be --Takashi Iijima-- therefor.

Signed and Sealed this

Twenty-eighth Day of July, 1998

*Attest:*

*Attesting Officer*

BRUCE LEHMAN

*Commissioner of Patents and Trademarks*